US006715419B2

(12) United States Patent
Schmid

(10) Patent No.: US 6,715,419 B2
(45) Date of Patent: Apr. 6, 2004

(54) METHOD AND DEVICE FOR PRODUCING A PRINTING IMAGE CARRIER ON PREFABRICATED CARRIER MATERIAL

(75) Inventor: Gotthard Schmid, Malsch (DE)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 09/918,146

(22) Filed: Jul. 30, 2001

(65) Prior Publication Data

US 2002/0033107 A1 Mar. 21, 2002

(30) Foreign Application Priority Data

Jul. 28, 2000 (DE) ..... 100 37 273

(51) Int. Cl.[7] ..... B41N 6/00; B41M 5/00
(52) U.S. Cl. ..... 101/401.1; 101/465
(58) Field of Search ..... 101/401.1, 465

(56) References Cited

U.S. PATENT DOCUMENTS

| | | | | |
|---|---|---|---|---|
| 5,129,321 A | | 7/1992 | Fadner | 101/467 |
| 5,355,795 A | | 10/1994 | Moss et al. | |
| 5,413,043 A | | 5/1995 | Fuhrmann et al. | |
| 5,870,955 A | * | 2/1999 | Williams et al. | 101/453 |
| 6,210,845 B1 | * | 4/2001 | Hotta et al. | 430/19 |
| 6,321,652 B1 | * | 11/2001 | Fujinami et al. | 101/465 |

FOREIGN PATENT DOCUMENTS

| | | | |
|---|---|---|---|
| DE | 43 03 872 A1 | 10/1993 | |
| DE | 19602289 A1 | 7/1997 | B41N/1/22 |
| DE | 197 53 744 A1 | 6/1999 | |
| EP | 0522804 A1 | 1/1993 | B41C/1/10 |
| EP | 0847853 A1 | 6/1998 | B41C/1/10 |

OTHER PUBLICATIONS

OneLook Search Dictionary, ,http//www.onelook.com, Mar. 15, 2002, word "polymer".*

Published International Application No. 00/37254 (Newington et al.), dated Jun. 29, 2000.

* cited by examiner

*Primary Examiner*—Stephen D. Meier
*Assistant Examiner*—Alfred E. Dudding
(74) *Attorney, Agent, or Firm*—Laurence A. Greenberg; Werner H. Stemer; Ralph E. Locher

(57) ABSTRACT

A method for producing a print carrier within a printing machine includes providing on a cylinder of the printing machine a prefabricated carrier material having a contact surface, and, within the printing machine, applying an impressionable polymer to the contact surface of the prefabricated carrier material; and a device for performing the method.

14 Claims, 4 Drawing Sheets

METHOD AND DEVICE FOR PRODUCING A PRINTING IMAGE CARRIER ON PREFABRICATED CARRIER MATERIAL

BACKGROUND OF THE INVENTION

1. Field of the Invention

The invention relates to a method and a device for producing a printing image carrier on prefabricated carrier material in a printing machine.

The published German Patent Document DE 195 3 6 884 C1 describes a device for wrapping a flexible printing image carrier around a printing form cylinder. Provided in the interior of the printing form cylinder is a first winding spool or coil for unwinding a printing image carrier which is drawable onto the casing or jacket surface of the printing form cylinder, and a second winding coil or spool for winding the printing image carrier drawn onto the jacket surface. Formed in the circumferential surface of the printing form cylinder is a single opening to an indentation in the interior of the printing form cylinder, wherein the first and the second winding spools or coils are arranged together. From this opening, the printing image carrier can be wound from the first winding coil or spool onto the jacket surface, and from the jacket surface onto the second winding coil or spool.

This heretofore known device of the German patent document is further characterized by the feature of a bearing part which is disposed so as to be removable from the interior of the printing form cylinder in the state wherein it is installed in the printing machine.

The European Patent Document EP 0 770 494 A2 is concerned with a method for making a printing form, the method being performed within a printing machine. An image-wise exposure of an image element takes place on a hydrophilic surface of a printing plate of an image-carrying layer. Contained in the image-carrying layer are hydrophilic thermoplastic polymer particles, which are dispersed in a hydrophobic binder. Furthermore, a mixture is provided which converts light into heat, the image element created in this way being applied to an impression cylinder which is provided in a rotary printing machine, and is inked via a dampening solution and/or ink during the rotation of the impression cylinder.

The published European Patent Document EP 0 802 457 A1 describes a device for producing and producing an image on a printing plate. A print carrier is disclosed, and equipment is provided for applying a uniform coating; devices are also provided for exposing the uniform coating in accordance with an image pattern, and further devices are provided for developing the uniform coating so that an image remains on the print carrier.

The printing image includes ink-accepting or ink-friendly areas on an ink-repellent background, or ink-repellent areas on an ink-accepting or ink-friendly background. The print carrier includes a cylinder, on the circumferential surface of which an element in sheet or plate form is mounted, the surface of the element being either an ink-accepting or ink-repellent type of surface. The aforementioned published European Patent Document EP 0 802 457 A1 also discloses a method for making a print carrier, the device described hereinabove being used therefor, as well as a coating fluid to be used in the device.

U.S. Pat. No. 5,713,287 discloses an imaging or image-generating method wherein the surface of a single-layer coating is modified.

In a direct imaging system with a gapless cylinder, the latter is provided in the printing machine with a radiation-curable polymer. After curing the polymer, the surface of the polymer is modified by selective irradiation with a laser light source, so that the affinity to the printing ink is changed. The cylinder thus formed is installed, in the place of a plate cylinder, in an offset printing machine, which operates either conventionally or without water. Because only the surface of the cylinder is selectively modified by the laser, the coating thickness and uniformity are of little concern. After the printing operation, the cylinder is cleaned, for which a cleaning station similar to a blanket washer in printing machines is installed. The cleaning operation does not have to be complete, because the surface of the cylinder of the printing unit is never entirely exposed to the printing ink. The proposed system is compatible with existing rotary printing-machine arrangements, because it can be accommodated in the area in the printing units presently provided for plate changing in the printing machines.

In the construction disclosed in the aforementioned U.S. Pat. No. 5,713,287, after the printing job has been completed, the polymer coating which is able to be influenced must be removed again, at least for the most part, from the surface of the print carrier, before a new neutral coating, i.e., a coating not yet irradiated by a laser light source, is applied as a precondition for a printing image to be newly generated by forming an image on the printing form in the printing machine for the next printing job. Even if the polymer coating is not completely removed from the surface of the printing form cylinder after the preceding printing job has been completed, the adhesion of the polymer to be newly applied for the next printing job must be so good that the polymer coating for the following job has the same high residence time on the printing form with repeated reproducibility.

It has been found that the adhesion between the contact surface of the carrier material to which the polymer coating to be influenced is applied, as well as the polymer material to be influenced, in repeated application of the treatable polymer material, is inadequate for achieving the same high and consequently adequate residence time of the print carrier as is the case when the treatable polymer is applied for the first time.

Attempts have been made to improve the inadequate adhesion between the contact surface of the carrier material and the treatable polymer by improving the composition, i.e., the formulation, of the treatable polymer. Furthermore, attempts have been made to improve the adhesion between the contact surfaces by optimizing the cleaning process and the cleaning agents provided therefor. Attempts have also been made to increase the adhesion of the polymer by selecting different carrier materials and the nature of the surface thereof and the surface roughness thereof, respectively. Furthermore, parameters specific to the printing machine, such as, for example, the pressing together of mutually cooperating roller surfaces, and inks of differing viscosity have been used.

SUMMARY OF THE INVENTION

It is accordingly an object of the invention to provide a method and a device for producing a printing image carrier in prefabricated carrier material in a printing machine with which it is possible to provide economically a polymer coating that can be influenced for the printing and can be disposed of readily after the printing.

With the foregoing and other objects in view, there is provided, in accordance with one aspect of the invention, a method for producing a print carrier within a printing machine, which comprises providing on a cylinder of the printing machine a prefabricated carrier material having a contact surface, and, within the printing machine, applying an impressionable or influenceable polymer to the contact surface of the prefabricated carrier material.

In accordance with another mode, the method of the invention includes prefabricating the carrier material in roll form on winding spools.

In accordance with a further mode, the method of the invention includes prefabricating the carrier material as an exchangeable sleeve, with the contact surface thereof receiving thereon the impressionable or influenceable polymer coating.

In accordance with an added mode, the method of the invention includes prefabricating the carrier material by pre-cutting it into sheet form, and preparing the contact surface thereof for adhesion with the impressionable polymer coating.

In accordance with an additional mode, the method of the invention includes removing the carrier material pre-cut into sheet form from a jacket surface of the cylinder and applying the carrier material to the jacket surface, respectively, by an automatic changing system.

In accordance with yet another mode, the method of the invention includes one of spraying the impressionable polymer and transferring the impressionable polymer from another medium, respectively, onto the carrier material, which has been suitably prepared, for effecting the adhesion thereof.

In accordance with yet a further mode, the method of the invention includes applying the impressionable polymer by contact application with an entrained surface of one of a rotational body and a band-shaped element, respectively.

In accordance with yet an added mode, the method of the invention includes fixing the impressionable polymer coating on the carrier material by irradiating the applied impressionable polymer coating.

In accordance with yet an additional mode, the method of the invention includes fixing the impressionable polymer coating by pre-heating the carrier material.

In accordance with still another mode, the method of the invention includes providing the carrier material in film form and of dimensionally stable polyester.

In accordance with still a further mode, the method of the invention includes providing the carrier material in a rounded form in the winding direction, and disposing the carrier material in a cavity formed in the printing form cylinder.

In accordance with still an added mode, the method of the invention includes, during an imaging and a printing process, bonding the carrier material by at least one of suction and magnetic cohesion to a jacket surface of the printing form cylinder.

In accordance with still an additional mode, the method of the invention includes, after completing a printing job, winding the carrier material on a jacket surface of the cylinder, unwinding a used portion of the carrier material from the jacket surface, and winding a portion of the carrier material to be provided with new polymer coating onto the jacket surface.

In accordance with another mode, the method of the invention includes forming the carrier material of polyester material that has been chemically and physically prepared for an application of the polymer coating and a fixing thereof on the surface of the carrier material.

In accordance with a further mode, the method of the invention includes applying and fixing the impressionable polymer simultaneously in all printing units of a printing machine.

In accordance with an added mode, the method of the invention includes reprocessing the used supply of carrier material outside the printing machine.

In accordance with an additional mode, the method of the invention includes performing an additional step of fixing the impressionable polymer coating applied to the carrier material which has been suitably prepared.

In accordance with yet another mode, the method of the invention includes providing the prefabricated carrier material as a roll, applying the roll outside the printing form cylinder, and automatically cutting off a required length of carrier material and mounting the length of carrier material on a jacket surface of the printing form cylinder.

In accordance with yet a further mode, the method of the invention includes providing a suitable roughness for producing a frictional connection between a jacket surface and an underside of the carrier material to be applied.

In accordance with yet an added mode, the method of the invention includes providing that the jacket surface of the printing form cylinder receiving the carrier material is porous.

In accordance with yet an additional mode, the method of the invention includes, following the end of the printing job, at least one of winding further and removing, respectively, the carrier material which can receive the impressionable polymer coating.

In accordance with another aspect of the invention, there is provided a printing machine having an impression cylinder, comprising a device for applying a prefabricated carrier material to the surface of the impression cylinder, and a device for applying an impressionable polymer to a contact surface of the prefabricated carrier material.

In accordance with a concomitant feature of the invention, the device for applying the prefabricated carrier material has winding spools.

The advantages of the method proposed according to the invention are to be seen in particular in that the influenceable or impressionable polymer coating on the carrier material does not have to be removed, not even partly, for the respective printing job that has been completed. This saves valuable time and dispenses with a cleaning device otherwise necessary for cleaning, which may cause disruptions in the overall performance of the process. The cleaning device otherwise to be provided also requires space, which is in any case limited and, furthermore, causes considerable production costs. According to the method preferably proposed in accordance with the invention, after completion of the respective printing job, the carrier material, which may, for example, be in the form of a film, is merely wound on, whereby the portion of the carrier material with which printing has just been performed is removed from the surface of the printing form cylinder and, for example, drawn into the interior of the printing form cylinder. At the same time, a new portion, not yet coated with the influenceable or impressionable polymer coating, is placed onto the jacket surface of the cylinder. This new portion is coated with an influenceable polymer either during the wind-up onto the jacket surface or after the winding and tensioning of the carrier material. This is followed by fixing the influenceable polymer coating in the printing machine, so that the printing machine is made-ready or prepared for the next printing job to be performed.

According to another advantageous implementational mode of the method of the invention, the carrier material is prefabricated in roll form on winding spools. This offers the advantage that the surface coming into contact with the influenceable polymer does not come into contact for a prolonged period with either light or oxygen, and consequently is well protected against oxidation and light. In addition, it is quite possible for the surface of the carrier material also to be prepared at low cost outside the printing machine in clean-room or under vacuum conditions.

In an alternative mode of the method proposed according to the invention, the carrier material can be prefabricated as a quickly exchangeable sleeve with a jacket or lateral surface receiving the influenceable polymer. The quickly exchangeable sleeve could be reprocessed offline or, if it is appropriately inexpensive, disposed of directly after completion of the printing job. The components of the sleeve-shaped carrier material may be produced, for example, from steel, aluminum, glass-fiber reinforced plastic material or suitable polyester material.

Furthermore, there is the possibility of using the method proposed according to the invention for storing the prefabricated carrier material in a spool device or some other suitable transporting device outside the printing machine and applying it as and when required to the surface of the printing form cylinder to be provided with the carrier material, detaching a corresponding portion of the prefabricated carrier material from this transporting device and applying it to the surface of the printing form cylinder to be provided therewith.

According to a further mode of the method proposed according to the invention, the prefabrication of the carrier material is possible as a pre-cut carrier material in sheet form. With such a fabricated carrier material, one surface is provided for the adhesion of the influenceable polymer coating, it being possible to use semi-automatic or fully automatic plate feeding systems of a known construction for applying such planar carrier material portions similar to printing plates.

The application of the impressionable or influenceable polymer coating to the surface of the carrier material prepared for the adhesion of the polymer coating may be effected by spraying with an appropriate spraying device or by material transfer from another medium. Apart from applying impressionable polymer in coating form by spraying it on or by material transfer from another medium, application of the impressionable polymer may also take place by contact with a concurrently moved or entrained surface. A concurrently moved or entrained surface may be, for example, the jacket surface of an application roller, or the upper side of an element in band form, which applies the polymer material and is driven externally or by the printing machine itself.

After the polymer coating has been applied in the manner proposed, in accordance with the invention, to the upper side of the carrier material suitable for the adhesion of the polymer coating, the application of the polymer coating takes place on the upper side of the carrier material on the cylinder, for example, the printing form cylinder of a rotary printing machine. The fixing of the influenceable polymer coating on the carrier material may take place on the one hand by irradiating the applied, influenceable polymer coating on the cylinder. For this purpose, a radiation source may be provided, which can be operated with different intensities over the width of the cylinder respectively receiving the carrier material, which also applies in an analogous way to the intensity control of the radiation source in the circumferential direction of the carrier material surface to be irradiated. Besides irradiating the freshly applied polymer coating on the carrier material on the lateral or jacket surface of a printing form cylinder, fixing of the influenceable polymer coating is also possible by pre-heating the carrier material. For pre-heating the carrier material, it is possible, for example, for the winding spools receiving the supply of carrier material and accommodated in the cavity of the cylinder to be traversed by heating medium, for example, temperature-controlled water, and for pre-heating the wound-up supply of carrier material.

The carrier material may be in sheet form on the winding spools, which are exchangeably fitted into the cavity of a printing form cylinder of a rotary printing press, and comprise dimensionally stable polyester material.

To ensure reproducibility and quality assurance, slippage of the carrier material provided with an influenceable polymer coating can be prevented during the imaging or printing process by suction and/or magnetic cohesion on the lateral surface of the printing form cylinder. According to the method proposed in accordance with the invention, after completion of the printing job, the carrier material, which is preferably stored in spool form in the interior of the printing form cylinder, can be wound on on the lateral surface of the cylinder, the used portion of the carrier material with the polymer coating taken up thereon being unwound from the jacket or lateral surface, and it being possible for a portion of the carrier material to be provided with a new polymer coating within the printing machine to be newly applied to the circumferential surface of the printing form cylinder.

In a preferred embodiment, the carrier material is a polyester material, which is chemically and physically prepared for the application of the polymer coating and the fixing thereof on the surface of the carrier material.

According to the method proposed in accordance with the invention, the influenceable polymer coating can be simultaneously applied in all the printing units of a printing machine comprising a plurality of printing units and can be fixed on the respective lateral surfaces of the printing form cylinders. After the supply winding spool has been used up, i.e., the winding spool taking up the used portion of the carrier material is filled with the used supply of carrier material, reprocessing of the used carrier material and conditioning of the surface can be performed outside the rotary printing press, so that the inexpensive carrier material can be used repeatedly.

Other features which are considered as characteristic for the invention are set forth in the appended claims.

Although the invention is illustrated and described herein as a method and device for producing a printing image carrier on prefabricated carrier material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
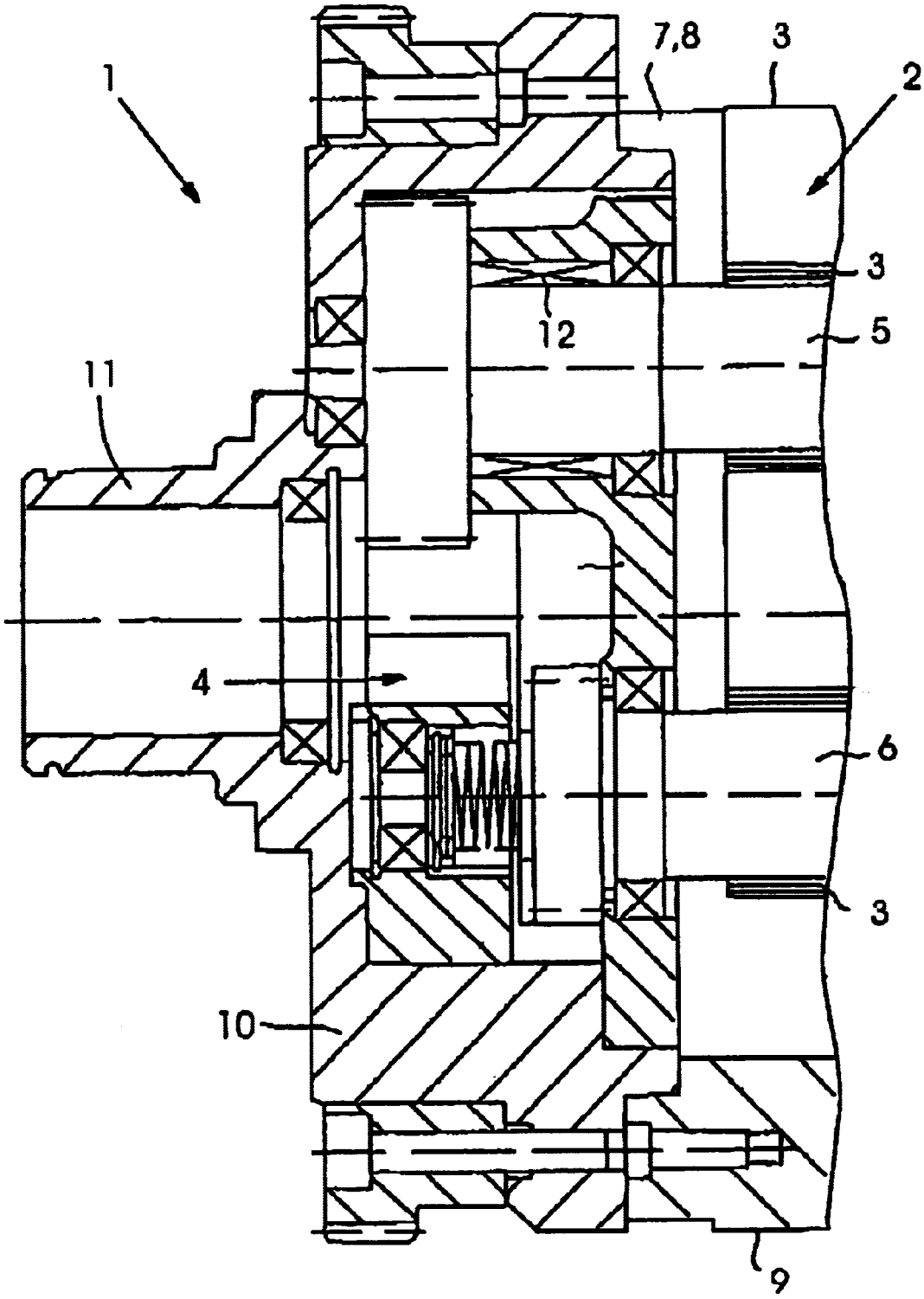
FIG. 1 PRIOR ART
FIG. 1 is a fragmentary cross-sectional view of a form cylinder with end-mounted carrier material spools or coils.

Referring now to the drawings and, first, particularly to FIG. 1 thereof, there is reproduced therein part of a printing form cylinder 1 of a rotary printing machine, the form cylinder 1 having a circumferential opening 2 formed in a lateral or casing or jacket surface 9 thereof. Accommodated in the interior 22 (note FIG. 3, particularly) of the printing form cylinder 1 is a rewind mechanism 4, which may include winding spools or coils 5 and 6. Through the intermediary of these winding spools or coils 5 and 6, of which one takes up an unused supply of carrier material 3 while the other serves for taking up the carrier material portion that has been unwound from the jacket surface 9, i.e., the used portion of the carrier material, the carrier material 3 is transported according to the printing job or order once again onto the jacket surface 9 of the printing form cylinder 1. The carrier material 3 can be coated with an impressionable polymer layer 16, which is yet to be described further hereinafter.

In the representation according to FIG. 1, a supply of a carrier material 3 may be provided in wound form on the winding spools 5 and 6, respectively, serving as sheet material in roll form for the printing form cylinder 1. The automatic rewind and tensioning device represented here as one of a number of conceivable embodiments winds up the supply of carrier material after completion of the printing job to the extent that a new unexposed portion of the carrier material 3 encloses the surface of the printing form cylinder 1 and can be exposed for the next printing job. According to the method of the invention which is proposed, the material stored in roll form is no longer to be the externally pre-coated printing plate, but rather, the appropriately fabricated and prepared polyester material suitable for the application of an impressionable or influenceable polymer.

The roll material, accommodated for example in roll form within a cavity of the printing form cylinder 1, may be polyester or an equivalent, particularly low-cost, material which remains dimensionally stable during the application of the polymer coating 16 and the fixing thereof on the carrier material 1, and which has on the surface 13 (note FIG. 1*a*) a contact area for the polymer coating to be applied. Polyester or other equivalent low-cost materials ensure a long service life of the printing form prepared in this manner, for medium and higher-volume jobs, even under operating conditions such as the printing of rough types of paper and the use of powder.

Figure 1A:
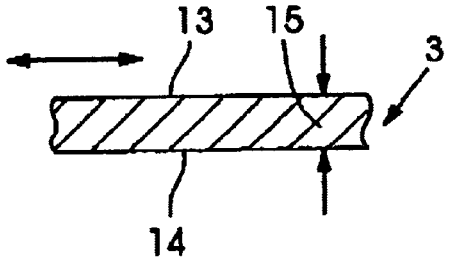
FIGS. 1*a* and 1*b* are fragmentary sectional views of the carrier material without and with polymer coating, respectively, which illustrate the nature of the carrier material.
Figure 1B:
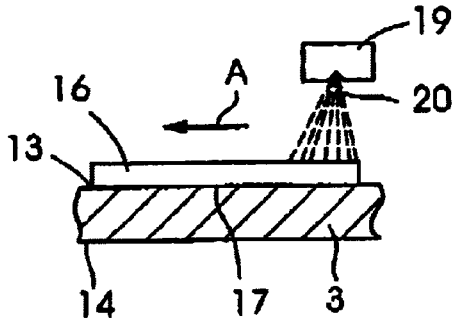

The nature of the film material serving as the carrier material is apparent in greater detail from FIGS. 1*a* and 1*b*.

In FIG. 1*a*, the carrier material 3 which, as already described hereinabove, may be polyester or a similarly related material, is represented with a material thickness 15 which is preferably only a few tenths of a millimeter, so that the carrier material 3 may be referred to as a carrier film. The carrier film has an upper side 13 and an underside 14 and, in the state wherein it is fabricated in roll form, can be moved in the direction of the double-headed arrow during the spraying movement in the circumferential direction on the surface 9, 24, respectively, of the printing form cylinder 1. Polyester is suitable preferably as the material for the carrier layer 3, because it remains dimensionally stable and has high residence times for jobs of medium and higher volume. One way in which the dimensional stability of a thin polyester material 16 can be improved is that, following the application of the impressionable polymer 16 according to FIG. 1*b* to the surface 15 of the carrier material 3, the latter is stabilized in the position thereof with the underside thereof either by applying negative pressure or by magnetizing the jacket surface 9, 24, respectively, of the printing form cylinder 1. This also prevents slippage of the underside 14 of the carrier material 3 on the jacket surface 9, 24, respectively, of the printing form cylinder 1. In addition, a special surface configuration of the pairing cylinder/underside of the carrier material 3 is possible, for example, by providing roughnesses which increase the friction of the material pairing, as well as, the formation of positively or formlockingly engaging projections, such as, for example, calottes or hemispherical elevations or different types of projections or the like. In this regard, it is noted that a formlocking connection is one which connects two elements together due to the shape of the elements themselves, as opposed to a forcelocking connection, which locks the elements together by force external to the elements. Another embodiment wherein the impressionable polymer 16 is applied to the carrier material 3 can be seen in greater detail in FIG. 1*b*.

Shown diagrammatically in FIG. 1*b* is an application device 19, having an application opening 20 from which there emerges a polymer spray mist which is deposited on the surface 13 of the carrier material 3 and, as viewed in the direction of application A, builds up an impressionable polymer coating 16 on the upper side 13 of the carrier material 3. In the region of the adhesion area 17, the impressionable polymer coating 16, which can be applied and is to be fixed in a further method step, and the upper side 13 of the carrier material 3 are bonded to one another. Besides the application device 19, which is represented in FIG. 1*b* in a diagrammatic arrangement by way of example and is equipped here as a spraying device, the impressionable polymer 16 can also be realized by material transfer from another medium to the carrier material 3. A contact application of the impressionable polymer 16 to the upper side 13 of the carrier material 3 by, for example, bringing into contact a roller body carrying the polymer coating 16, or an externally driven element in band form, can effect a material transfer to the surface 13 of the carrier material 3.

The carrier material 3 represented in FIGS. 1*a*, 1*b* and FIG. 1 may be available not only in fabricated roll form but also as a finite pre-cut carrier material 3 in sheet form. In this regard, the portion of the carrier material 3 to be applied to the jacket surfaces 9 and 24, respectively, of the printing form cylinder 1 is fabricated in the form of a bent printing plate, adapted to the curvature of the jacket surface 9 and 24, respectively, of the printing form cylinder 1. After completion of the printing job, this printing plate can be removed from the jacket surfaces 9 and 24, respectively, of the printing form cylinder 1 by heretofore known manual semi-automatic or automatic printing plate changing devices and can also be applied to the jacket surfaces 9 and 24, respectively, of the printing form cylinder by these feeding devices. Besides the possibility of being fabricated as a pre-cut carrier material 3 in sheet form or as a material wound in roll form on jacket surfaces of winding spools, the carrier material 3 can also be fabricated in the form of quickly exchangeable sleeves, which can be reprocessed outside the printing machine and disposed of or reprocessed directly after completion of the printing job. Such quickly exchangeable sleeves can be produced as thin polyester tubes, which, when there is an appropriate number of them, can also be removed directly after completion of a respective printing job.

The prefabrication of the carrier material 3 as roll material which can be stored on the winding spools 5 and 6 in the cavity 22 of the printing form cylinder 1 offers the advantage that the surface 13 of this carrier material 3 cannot come into contact with either light or oxygen over a prolonged period at the contact surface 13, which is prepared for receiving the impressionable polymer 16, due to the accommodation thereof in the cavity 22 of the printing form cylinder 1. Protection of the contact surface 13 on the carrier material 3 is thus provided against oxidation of the surface 13 and the incidence of light. This surface 13 of the carrier material 3 can then also be produced at extremely low cost outside the printing machine in a clean room or vacuum environment.

The carrier material 3 can, if necessary, also be reprocessed outside the printing machine. For this purpose, the used carrier material 3 can be cleaned and the surface 13 newly prepared for the adhesion of an impressionable polymer 16, so that a shaping operation can follow. Consequently, the consumption of carrier material 3 can be reduced by the repeated use thereof.

Figure 2:
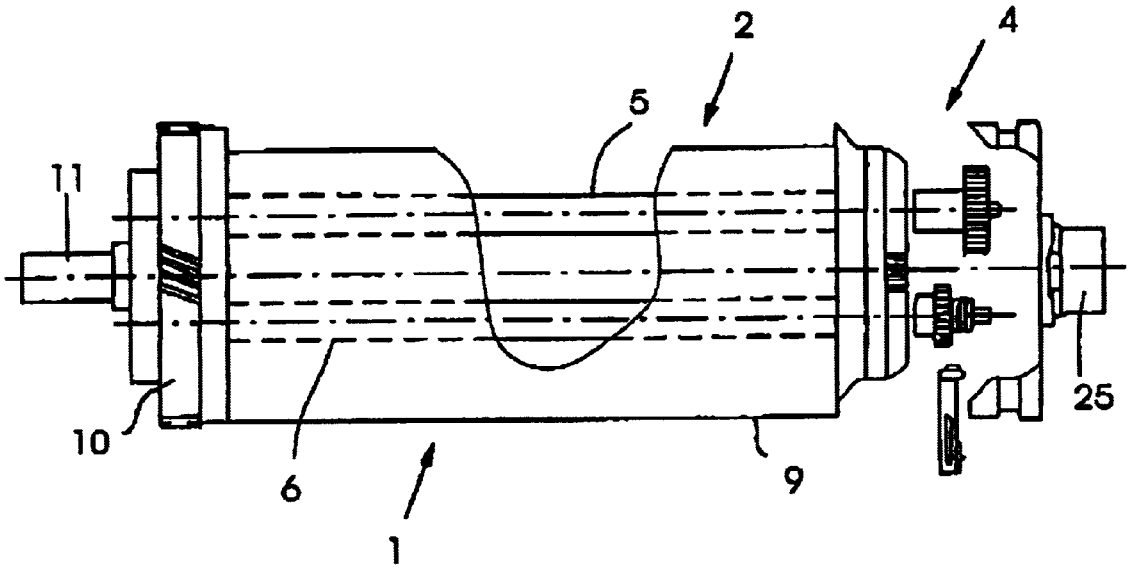
FIG. 2 PRIOR ART
FIG. 2 is a diagrammatic longitudinal view, partly broken away and partly exploded, of a printing form cylinder with cylinder ends which are disassemblable outside the printing machine.

The representation according to FIG. 2 is a diagrammatic view of a printing form cylinder 1, in the interior of which, otherwise not represented here in any greater detail, winding coils or spools 5 and 6 are laterally recessed beneath the jacket surface 9. Regardless of whether the drive of the winding spools 5 and 6, which are accommodated in the interior of the printing form cylinder 1 and wind a supply of carrier material over the jacket surface 9 of the printing form cylinder 1, are driven from the outside or from the inside, these versions of the method proposed in accordance with the invention share the advantage that the carrier material 3 is protected against premature oxidation by the oxygen atmosphere surrounding it and against premature aging by excessive incidence of light.

The printing form cylinder 1 shown diagrammatically in FIG. 2 includes two journals 11 and 25, respectively. The printing form cylinder 1 is mounted by the journals 11 and 25 in the side walls of a printing unit of a rotary printing machine. During the rotation of the form cylinder 1 about the axis of rotation thereof, gearwheels provided on one of the ends of the printing form cylinder 1 can induce an advancement of the windable carrier material 3 on the jacket surface 9 corresponding to the rotation of the printing form cylinder 1 about the axis thereof, by a latching drive or by a toothing. Shown in FIG. 3 is a printing form cylinder 1 of a rotary printing machine, in the interior of which winding spools 5 and 6 can be rotatably mounted according to the representation in FIG. 1.

Figure 3:
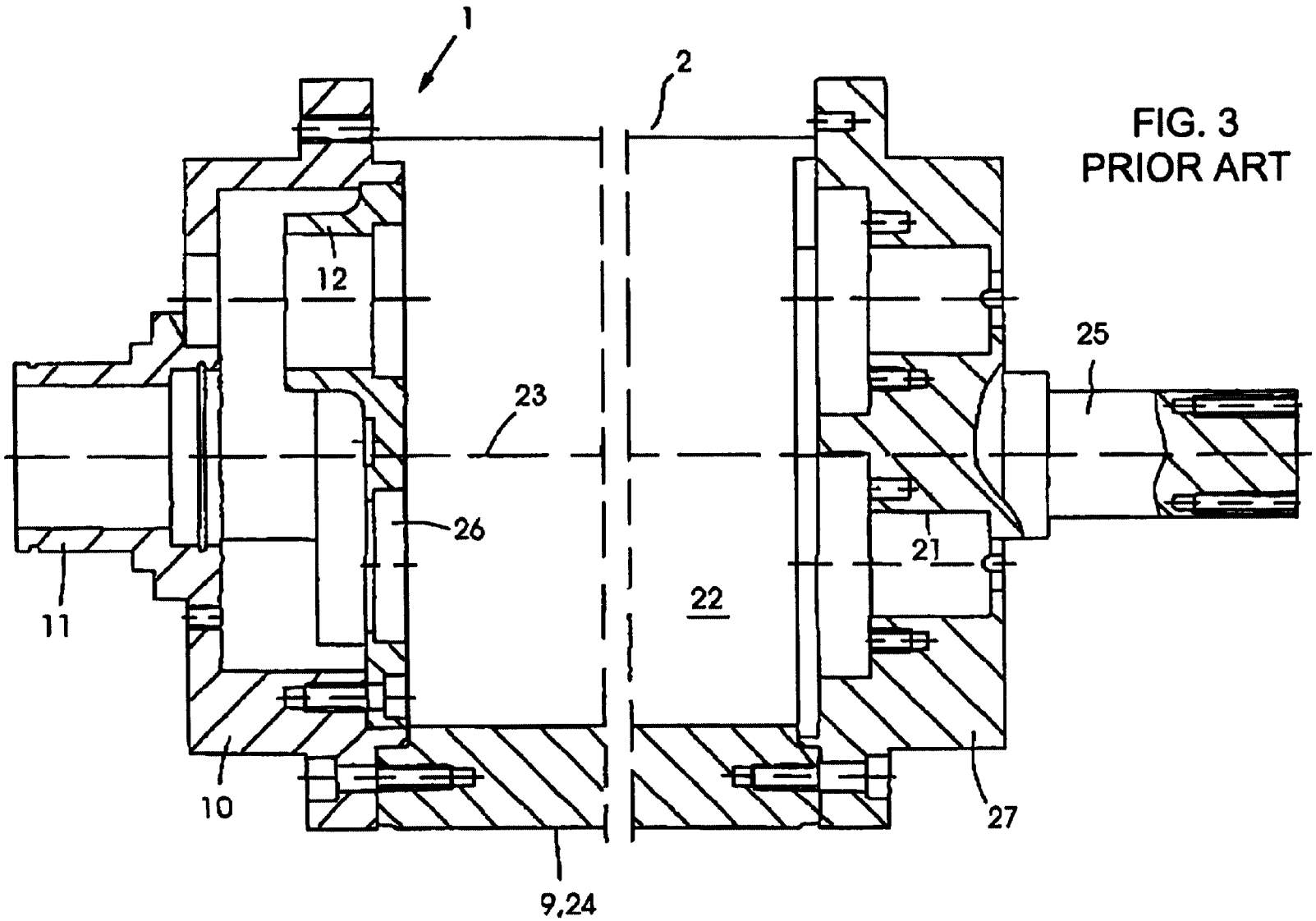
FIG. 3 PRIOR ART
FIG. 3 is a longitudinal foreshortened sectional view of a printing form cylinder, in an inner cavity of which winding spools for receiving a carrier material in roll form are exchangeably recessed.

The printing form cylinder 1 of FIG. 3 has two bearing journals 11 and 25 analogous to the representation of the printing form cylinder 1 according to FIG. 2, by which the printing form cylinder 1 can be rotatably received in the side walls of a rotary printing machine. The printing form cylinder 1 rotates about the axis of rotation 23 thereof and includes a jacket surface 9 and 24, respectively, which is formed with an opening 2, the underside 14 of the carrier material 3 represented in FIGS. 1*a* and 1*b* lying on the respective jacket surface 9, 24.

The printing form cylinder according to FIG. 3 includes two ends 10 and 27, into which the ends of the winding spools 5 and 6 (note FIG. 1) can be recessed. Bearing bushings 12 and 26, respectively, have been recessed into the end 10, whereas journal openings 21 have been formed in the end 27 of the printing form cylinder 1, allowing the ends of the winding spools 5 and 6, respectively, to be received therein opposite the end 10 of the printing form cylinder 1. The carrier material 3 respectively taken up on the circumferential surfaces of the winding spools 5 and 6 is accommodated in the cavity 22 of the printing form cylinder 1, is enclosed to the greatest extent by the cavity 22 and leaves or enters the cavity 22 through the opening 2, which represents an interruption in the circumferential lateral or jacket surface 9, 24, respectively, of the printing form cylinder 1.

Both on the jacket surface 9, 24, respectively, of the printing form cylinder 1 according to FIG. 3 and on the lateral or jacket surface 9 of the printing form cylinder 1 according to FIG. 2, not only carrier materials 3 fabricated in roll form but also pre-cut carrier material portions in sheet form can be mounted. These can be tensioned in the circumferential direction, for example, by tensioning devices which are similar to those for the tensioning of printing plates on the circumference of the printing form cylinder 1. By tensioning the carrier material 3, slippage thereof can be prevented, so that the carrier material 3 can be held in a reproducible position, possibly assisted by magnetic cohesion or a suction system on the printing form cylinder 1.

The surface 13 of the carrier material 3 according to FIGS. 1*a* and 1*b* has been chemically and physically prepared so that it can be provided with the impressionable or influenceable polymer 16, whether applied by spraying, contact with rotating surfaces or by material transfer from another medium with a polymer coating 16. By applying the polymer coating 16 to the surface 13 of the carrier material 3 in all the printing units of a printing machine simultaneously and by simultaneously exposing the polymer coatings 16 applied to and fixed on the carrier materials, all the printing units are made-ready simultaneously for the forthcoming printing job. In the following method step, after the polymer coating 16 has been fixed on the contact surface 13 of the carrier material 3, the printing job is printed. Following the application of the impressionable polymer, whether by spraying, contact application or by material transfer, the polymer 16 applied in such a way is fixed. The fixing of the polymer coating 16 on the contact surface 13 of the carrier material 3 may be effected by irradiating the impressionable polymer with a radiation source, for example an infrared radiator, a UV radiator or a laser or, in an alternative embodiment, by pre-heating the carrier material 3 itself. This allows, for example, the heating of the winding spools 5 and 6, respectively, on the circumference of which the carrier material 3 can be taken up, so that the supply of carrier material 3 taken up on the circumferential surfaces of the winding spools 5 and 6, respectively, according to FIG. 1, can be made-ready beforehand in this form of fabrication. It is also conceivable to initiate the fixing of the impressionable polymer by heating the printing form cylinder 1.

After applying the polymer coating 16 to the surface 13 of the carrier material 3 and forming an adhesive bond between the impressionable polymer coating 16 and the carrier material 3 within the adhesive zone 17, an exposure of the polymer coating can take place and, then, printing of the printing job. During the imaging and subsequent printing process, the carrier material 3 is held in a dimensionally stable and non-slip manner on the jacket surface 9, 24 of the printing form cylinder 1, possibly assisted by suction or by magnetic cohesion. After completion of the printing job, if the carrier material 3 is prefabricated in roll form, the latter is wound on by just driving the winding coils or spools 5 and 6, the used portion of the carrier material which has just been used for printing then disappearing in the cavity 22 of the printing form cylinder 1 on the circumference of the rewind spool. At the same time, a new portion of the carrier material, which is not yet provided with a polymer coating 16, is wound onto the jacket surface 9, 24 of the printing form cylinder 1. The new portion is then coated with an impressionable polymer 16 either during the wind-up onto the jacket surface 9, 24 of the printing form cylinder 1 or after the rewind and the subsequent tensioning of the new portion of the carrier material 3 have taken place. This may be performed, as diagrammatically represented in FIG. 1*b*, by spraying-on by an application device 19 in the direction of advancement 18 of the carrier material 3. This is followed by fixing the impressionable polymer coating 16 just applied, after which the rotary printing machine is ready again for the next exposing process and the subsequent printing of the next printing job. By contrast with the heretofore known devices from the prior art, the method proposed according to the invention can achieve the effect that the impressionable polymer coating 16 on the carrier material 3 need not be removed from the carrier material 3 after completion of the printing job. As a result, considerable set-up or make-ready time is saved, because, just by rewinding, the previously used portion of the carrier material 3 with the polymer coating 16 applied thereto simply disappears in the interior 22 of the printing form cylinder 1 and, at the same time, a new portion of the carrier material 3 is moved onto the jacket surface 9, 24 of the printing form cylinder 1 for application, fixing and exposure. This saves time and dispenses with the need for a cleaning device, which otherwise has to be provided and requires considerable space, or entails considerable production costs and can interfere considerably with the overall performance of the process. It should be pointed out once again that the fabrication of the carrier material in roll form merely represents one of a number of possible alternatives. The carrier material 3 may similarly also be formed as a sleeve or of finite planar portions fabricated in sheet form similar to printing plates.

If, for example, SFI inks (single fluid inks) are used, the method proposed according to the invention can also be used on rotary printing machines without dampening units, even though printing forms for conventional offset printing can be used. The prefabrication of the carrier material 3 in roll form on the circumferential surfaces of winding spools 5 and 6, respectively, may also be used in conventional offset printing machines with dampening units and printing form cylinders with an automatic rewind device.

Figure 4:
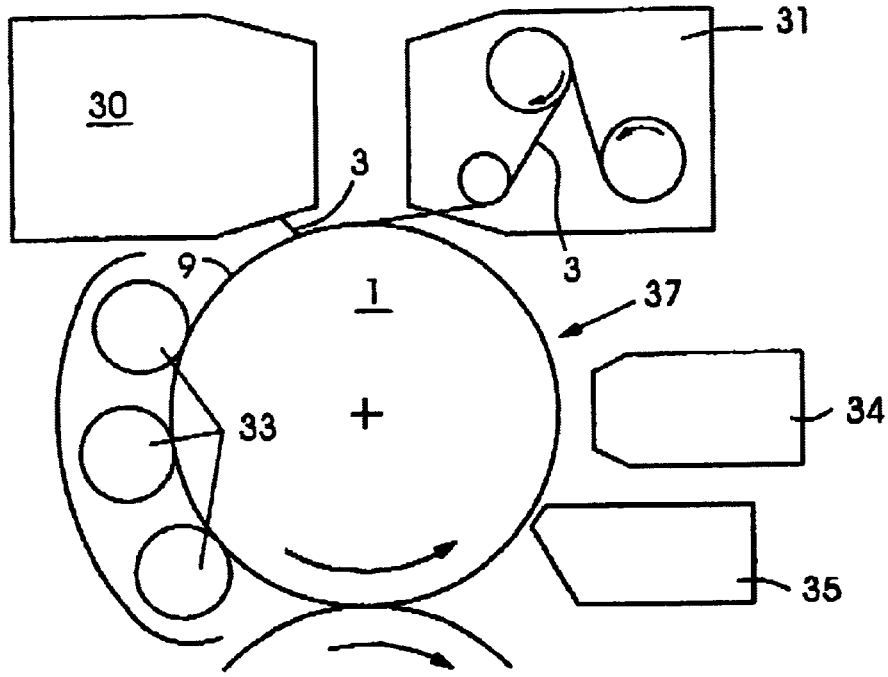
FIG. 4 is a diagrammatic view of a possible arrangement of a transporting device for the carrier material to be applied, which is provided outside the rotary printing machine.

In the configuration according to FIG. 4, an automatic rewind device arranged outside the printing form cylinder 1 is represented.

The rewind device for the carrier material 3 includes a dispensing head 31 and a consuming head 30, taking up the consumed material. The carrier material 3 taken up on a winding spool within the feeding unit 31 is separated from a coating by a take-up roller, so that only the carrier material 3 runs onto a first deflecting roller. By the two units 30 and 31 arranged outside the jacket surface 9 of the printing form cylinder 1, a prefabricated material 3 is conveyed outside the printing form cylinder 1. In accordance with the requirement for carrier material 3 on the jacket surface 9 of the printing form cylinder 1, the material in an appropriately fabricated form is moved over the jacket surface 9 of the printing form cylinder 1, applied to the latter and separated from the feeding unit 31, i.e., from the winding coils or spools 5 and 6, respectively, taking up the carrier material 3.

The circumferential surface 9, 37 of the printing form cylinder 1 is consequently to be assigned the supply of carrier material 3 which is arranged outside the printing form cylinder 1 of the rotary printing machine and which, according to the proposed method of the invention, is to be cured on the surface 9 or 37 of the printing form cylinder 1 after being applied thereto, in order to prevent premature wearing of the carrier material 3 and ensure that, after applying a coating of impressionable polymer 16 to the upper side of the carrier material 3, the inking takes place by the application rollers 33 which are only diagrammatically represented here. In addition, the surface 37 or 9 of the printing form cylinder 1 has an imaging unit 34 and a cleaning device 35 assigned thereto.

Figure 5:
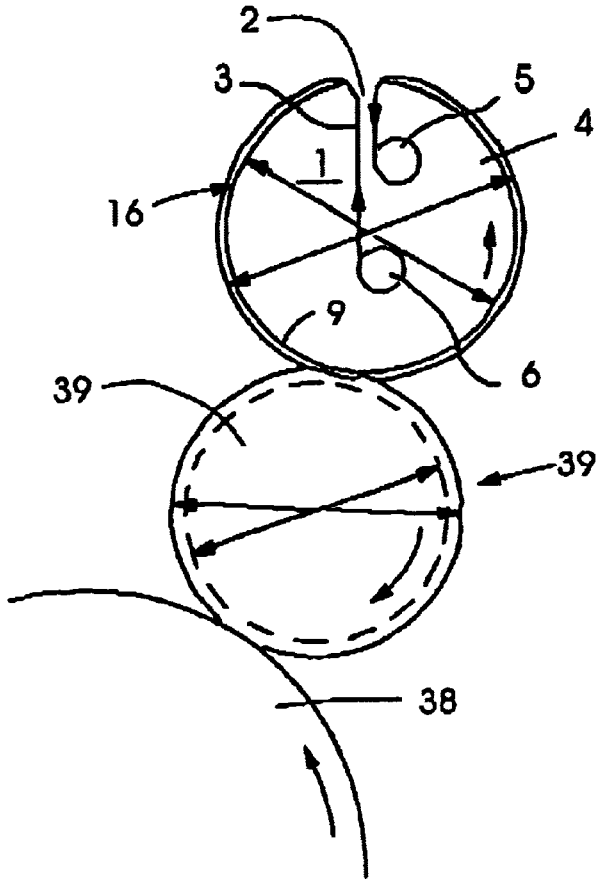
FIG. 5 is a diagrammatic sectional view of the printing form cylinder, a transfer cylinder and an impression cylinder of the rotary printing machine.

The representation according to FIG. 5 shows in greater detail a sectional profile perpendicular to the axis of rotation of the printing form cylinder 1.

The printing form cylinder 1 shown in the aforedescribed FIGS. 1 and 3 is provided in the jacket surface 9 thereof with a recess 2, through which access to the interior 22 of the printing form cylinder 1 is ensured. Mounted removably in the interior of the printing form cylinder 1 is a first winding coil or spool 5, which takes up the carrier material coating to be removed from the circumferential surface 9 of the printing form cylinder 1, and a further winding spool 6, which has a supply of carrier material 3 fabricated as a roll which, after unrolling of the used layer of carrier material 3 together with the polymer coating applied thereto, is removed from the jacket surface 9 of the printing form cylinder 1, so that the layer of carrier material 3 to be newly unwound in the direction of the arrow from the winding coil or spool 6, in turn, passes onto the jacket surface 9 of the printing form cylinder 1 as an unused supply of carrier material.

After the impressionable polymer coating has been applied and possibly fixed on the surface of the layer of carrier material 3, it is inked by the application rollers 33 according to the representation in FIG. 4. The printing image 8 inked in such a way is transferred in the printing nip between the jacket surface 9 of the printing form cylinder 1 and the jacket surface of the transfer cylinder 39, so that the printing image can be printed onto the surface of a printing material passing the printing nip between the transfer cylinder 39 and the impression a cylinder 38.

For better accessibility of the cavity 22 of the printing form cylinder 1, the latter is provided in the jacket surface thereof with an opening 2, through which the accessibility to the cavity 22 of the printing form cylinder 1 is assured.

I claim:

1. A method for producing a print carrier within a printing machine, which comprises:

providing a prefabricated carrier material having a contact surface, on a surface of a cylinder of the printing machine;

producing a frictional connection between the cylinder surface and an underside of the carrier material to be applied; and applying an impressionable polymer to the contact surface of the prefabricated carrier material within the printing machine.

2. The method according to claim 1, which includes prefabricating the carrier material in roll form on winding spools.

3. The method according to claim 1, which includes prefabricating the carrier material as an exchangeable sleeve, with the contact surface thereof receiving thereon the impressionable polymer coating.

4. The method according to claim 1, which includes prefabricating the carrier material by pre-cutting it into sheet form, and preparing the contact surface thereof for adhesion with the impressionable polymer coating.

5. The method according to claim 4, which includes removing the carrier material pre-cut into sheet form from a jacket surface of the cylinder and applying the carrier material to the jacket surface, by an automatic changing system.

6. The method according to claim 1, which includes one of spraying the impressionable polymer and transferring the impressionable polymer from another medium, onto the prepared carrier material to effect the adhesion thereof.

7. The method according to claim 1, which includes applying the impressionable polymer by contact application with an entrained surface of one of a rotational body and a band-shaped element.

8. The method according to claim 1, which includes fixing the impressionable polymer coating on the carrier material by irradiating the applied impressionable polymer coating.

9. The method according to claim 1, which includes fixing the impressionable polymer coating by pre-heating the carrier material.

10. The method according to claim 1, which includes providing the carrier material in film form and of dimensionally stable polyester.

11. The method according to claim 1, which includes applying and fixing the impressionable polymer simultaneously in all printing units of a printing machine having a plurality of printing units.

12. The method according to claim 1, which includes reprocessing the used supply of carrier material outside the printing machine.

13. A method for producing a print carrier within a printing machine, which comprises:

providing a prefabricated carrier material having a contact surface, on a surface of a cylinder of the printing machine;

applying and fixing an impressionable polymer to the contact surface of the prefabricated carrier material simultaneously in all printing units within a printing machine having a plurality of printing units.

14. A method for producing a print carrier within a printing machine, which comprises:

providing a prefabricated carrier material having a contact surface, as a roll, applying the roll outside a printing form cylinder of the printing machine, and automatically cutting off a required length of carrier material and mounting the length of carrier material on a jacket surface of the printing form cylinder; and applying an impressionable polymer to the contact surface of the prefabricated carrier material within the printing machine.

* * * * *